US005967406A

United States Patent [19]

Moorman

[11] Patent Number: 5,967,406

[45] Date of Patent: Oct. 19, 1999

[54] CONTAINER CONVERTIBLE BETWEEN SHIPPING AND SHIPPING/DISPLAY MODES

[75] Inventor: Stephen E. Moorman, Lawrenceville, Ga.

[73] Assignee: Georgia Pacific Corporation, Atlanta, Ga.

[21] Appl. No.: 09/093,938

[22] Filed: Jun. 9, 1998

[51] Int. Cl.[6] ..... B65D 5/48

[52] U.S. Cl. ..... 229/120.37; 206/427; 206/747; 206/766; 206/773; 229/120.38; 229/122.26; 229/164

[58] Field of Search ..... 229/120.09, 120.24, 229/120.26, 120.37, 120.38, 122.26, 164; 206/427, 431, 745, 747, 759, 760, 766, 770, 772, 773, 774

[56] References Cited

U.S. PATENT DOCUMENTS

| | | | |
|---|---|---|---|
| 1,770,348 | 7/1930 | Bliss . | |
| 1,974,527 | 9/1934 | Bliss . | |
| 2,823,794 | 2/1958 | Garman | 206/760 |
| 3,227,266 | 1/1966 | Soma | 229/164 |
| 3,285,399 | 11/1966 | Snow | 229/164 |
| 3,343,659 | 9/1967 | Marondel . | |
| 3,348,667 | 10/1967 | Beeby . | |
| 3,921,893 | 11/1975 | Randle, Jr. . | |
| 4,194,678 | 3/1980 | Jasper . | |
| 4,282,999 | 8/1981 | Moen . | |
| 4,394,905 | 7/1983 | Hackenberg . | |
| 4,607,750 | 8/1986 | Valenti . | |
| 4,865,187 | 9/1989 | Zulauf et al. . | |
| 4,871,067 | 10/1989 | Valenti . | |
| 4,951,867 | 8/1990 | McManus . | |
| 5,350,111 | 9/1994 | Vosbikian . | |
| 5,372,299 | 12/1994 | Edgerton, Jr. et al. . | |
| 5,464,149 | 11/1995 | Fowler et al. . | |
| 5,555,982 | 9/1996 | Kuhn et al. . | |
| 5,657,872 | 8/1997 | Leftwich et al. | 206/766 |

OTHER PUBLICATIONS

Moen Industries brochure: "Leave The Competition Behind With The New Fort Bliss Display", 1997.

*Primary Examiner*—Gary E. Elkins
*Attorney, Agent, or Firm*—Banner & Witcoff, Ltd.

[57] ABSTRACT

A shipping container formed from three blanks of sheet material (e.g., corrugated fiberboard) is convertible between a full-wall shipping mode and a partial-wall shipping/display mode. A first blank forms a wrap-style tray and the other two form identical convertible sidewall/divider components secured within the tray. In the shipping mode, the convertible sidewall/divider components form opposing sidewall portions of the container covering (preferably completely) the container sides between end walls of the tray. In this mode, the container is well suited for the shipment of empty plastic bottles and like contents to a product manufacturer who will fill the bottles with flowable (e.g., liquid) product and repack them after converting the container to the shipping/display mode. By pressing inwardly on a main panel of each convertible sidewall/divider component, a pivot action of doubled-back pivot panels attaching the main panel to the end walls of the tray converts the container to the shipping/display mode. In this mode, the main panels form reinforcing H-type (or similar) container divider structure and leave largely open container sides. This configuration is well suited for the shipment of filled bottles or the like to a retailer in a stackable display-ready form.

21 Claims, 8 Drawing Sheets

CONTAINER CONVERTIBLE BETWEEN SHIPPING AND SHIPPING/DISPLAY MODES

BACKGROUND OF THE INVENTION

The present invention relates to container constructions and, more particularly, to containers used for both shipping and display at the site of delivery.

The main function of a shipping container is to provide a means of enclosing and protecting goods for shipment in various sized lots. The container must be of sufficient strength and rigidity to withstand stacking and other handling loads without damage to the goods enclosed therein. Vertical loads, which occur as a result of stacking, are a great concern. Also, goods within the container may shift during handling, potentially causing abrasive wear and breakage. A standard container, such as disclosed in Bliss U.S. Pat. No. 1,974,527, reduces these problems by inclusion of a divider structure comprising a pair of separate blanks insertable into the container back-to-back to form an H-type divider. The divider separates the goods and increases the strength and rigidity of the container. Integrally formed H-type container dividers are also known. These are generally similar to the divider of the aforementioned Bliss patent, but with a pair of like divider structures being integrally hinged together instead of separate. See, e.g., U.S. Pat. No. 5,464,149 to Fowler et al.; U.S. Pat. No. 4,282,999 to Moen; U.S. Pat. No. 4,194,678 to Jasper; and U.S. Pat. No. 3,921,893 to Randle.

Retail establishments expend considerable resources in the construction of displays which attract the eye of the consumer and inform consumers of the nature of the goods offered for sale. Therefore, it is advantageous if the retailer can receive goods from the manufacturer in containers that may also serve effectively as a display. To this end, several patents disclose shipping containers convertible into a display mode that allows the containers to be stacked and the goods to be seen within the containers. See, e.g., U.S. Pat. No. 4,871,067 to Valenti and U.S. Pat. No. 5,372,299 to Edgerton, Jr. et al. These designs lack an H-type divider, and the inherent strength and stability provided thereby.

A conventional approach to shipping/display convertibility is the use of regular slotted containers (RSC's) provided with perforated tear-out sidewall panels and internal dividers. In a typical application, a bottled product manufacturer receives RSC's loaded with empty plastic bottles from a bottle producer. Upon receipt, the product to manufacturer opens the container, removes the bottles and fills them with the flowable product to be sold. Typically, a worker will manually remove the tear-out panels from the RSC sidewalls and reload filled and capped bottles into the converted display-suitable container, for shipment to a retail establishment. Full-wall panels as provided by the RSC's before conversion are desired for shipment of the empty (capless) bottles to help avoid contamination of the bottle interiors. Also, because capless bottles are typically shipped to the manufacturer upside down (as a further way to avoid contamination), the upside down orientation of the empty bottles renders them prone to falling out of a container with display gaps in the sidewalls. Full-wall panels eliminate this problem.

While tear-out panel type RSC's provide shipping/display convertibility, they do not provide an ideal solution. In particular, manual removal of the tear-out panels is costly and time consuming when large quantities of containers are involved. Moreover, the provision of separate wall panels and divider structures fails to take advantage of the fact that a divider structure is unnecessary when shipping empty (light) containers in the full-wall shipping mode. Substantial savings in material cost could be realized if a configuration was provided allowing effective conversion of a wall panel structure into a divider structure.

U.S. Pat. No. 3,348,667 to Beeby (the '667 patent) discloses another type of container convertible between a shipping and display mode. In a shipping mode, four separate scored and foldable U-shaped blanks form the walls of a shipping container comprising a base tray with abbreviated (short) walls. An identical tray is used as a cap. To achieve a display mode, the U-shaped blanks are removed from the trays, reversed in orientation and replaced back-to-back in the base tray to form an H-type divider. A drawback of the container of the '667 patent is that means such as packing tape and the press fit caps are apparently necessary to impart sufficient structural integrity for shipping. Application of packing tape and/or other wrapping materials requires additional expense and effort on the part of the product manufacturer, and, once effected, makes conversion to a display mode more difficult.

SUMMARY OF THE INVENTION

In view of the foregoing, it is a principal object of the present invention to provide a container which can be easily and efficiently converted between a shipping mode and a shipping/display mode.

More specifically, it is an object of the invention to provide a convertible container as aforesaid, that minimizes sheet material requirements through the provision of dual purpose container components serving alternatingly as both sidewall and divider structures, without a concomitant need for additional steps and material to provide a high degree of structural integrity.

These and other objects are achieved by the present invention which, in a first aspect, is embodied in a container convertible between a shipping mode and a shipping/display mode. A tray includes a floor and a pair of sidewalls and end walls connected to the floor. The sidewalls have an abbreviated height relative to the end walls. A convertible sidewall/divider component is secured within the tray. The component comprises a main panel extending above the sidewalls of the tray. The main panel is positioned along a respective one of the sidewalls to form a sidewall extension above the sidewall in the shipping mode. The main panel is movable within the tray, without removal therefrom, to a position spaced inwardly from the respective sidewall to form a divider defining separate compartments of the container visible above the respective sidewall in the shipping/display mode.

In another aspect, the invention resides in a container convertible between a shipping mode and a shipping/display mode. A tray of the container includes a floor and a pair of sidewalls and end walls connected to the floor. The sidewalls have an abbreviated height relative to the end walls. A convertible sidewall/divider component is secured within the tray. The component includes a pair of connecting panels connected to interior sides of the end walls. A pair of pivot panels is attached to respective ones of the connecting panels. The pivot panels overlap the connecting panels in one of the shipping mode and shipping/display mode. The pivot panels are pivotable with respect to the respective connecting panels to respective positions adjacent and generally co-planar with the respective connecting panels to effect a conversion of the container to the other one of the modes. A main panel is attached to and extends between the pivot panels, and above the sidewalls of the tray. The main panel is positioned flush against a respective one of the sidewalls to form a sidewall extension above the sidewall in the shipping mode. The main panel is spaced inwardly from the respective sidewall in the shipping/display mode to form a divider defining separate compartments of the container visible above the respective sidewall.

In yet another aspect, the invention is embodied in a convertible sidewall/divider component for use in a container convertible between a shipping mode and a shipping/display mode. The convertible component includes a pair of connecting panels. A pair of pivot panels are attached to respective ones of the connecting panels. The pivot panels are doubled back into overlapping relationship with the connecting panels to achieve one of the shipping mode and said shipping/display mode. The pivot panels are pivotable with respect to the respective connecting panels to achieve the other of the modes. A main panel is attached to and extends between the pivot panels. The main panel comprises at least one score line that allows the main panel to buckle during a conversion between the shipping mode and the shipping/display mode.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
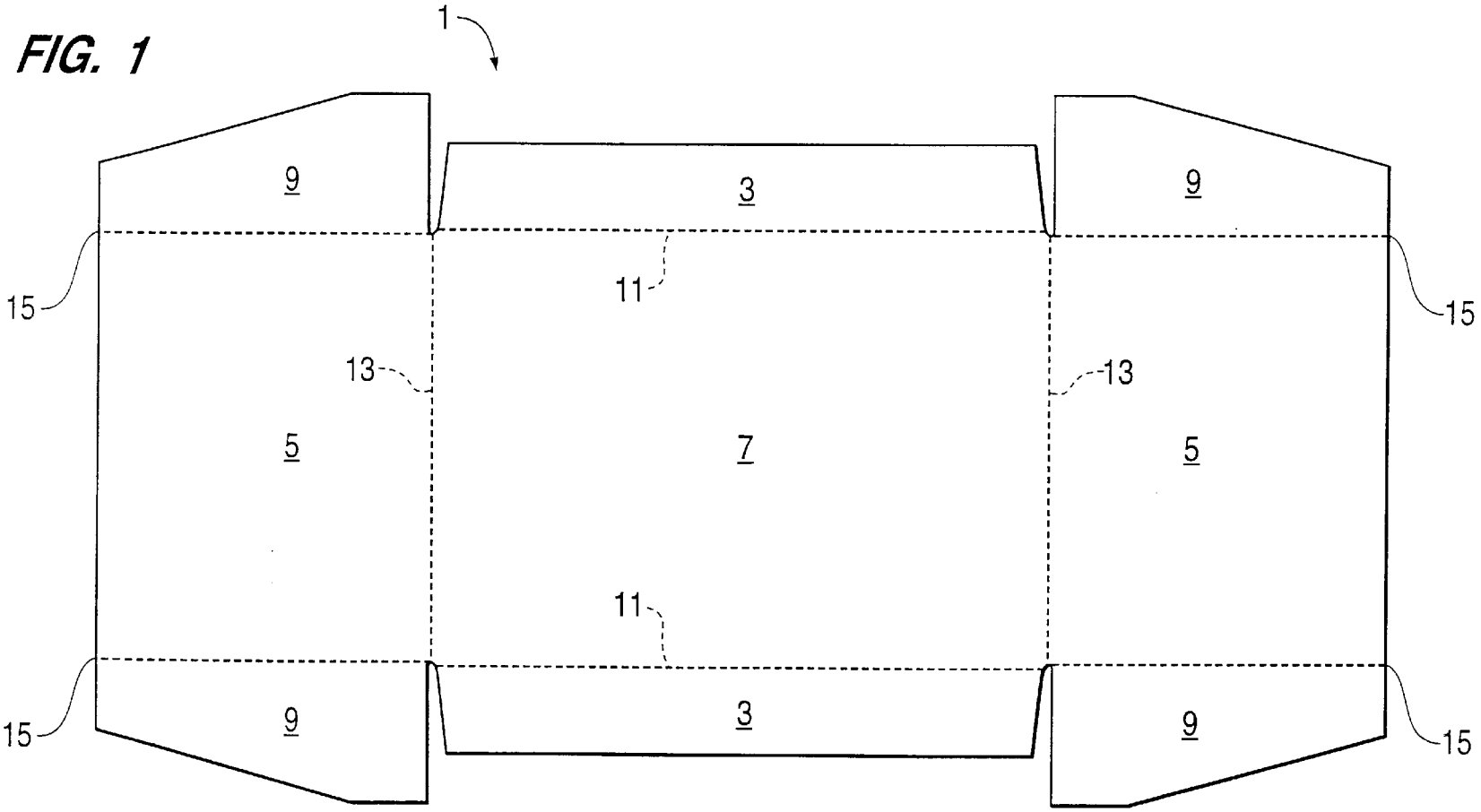
FIG. 1 is a plan view of a scored and cut blank foldable into a wrap-type tray forming a first component of a convertible container in accordance with the present invention.

Referring first to FIG. 1, a blank 1 for forming a wrap-type (harness style) tray component of a container in accordance with the present invention comprises a sheet of foldable material (e.g., corrugated fiberboard) die cut and scored as shown by the broken lines. Blank 1 includes a pair of abbreviated (relatively short) side wall panels 3, a second pair of relatively tall end wall panels 5, a floor panel 7, and a set of corner flaps 9 emanating from the lateral sides of each end wall panel 5.

Figure 3:
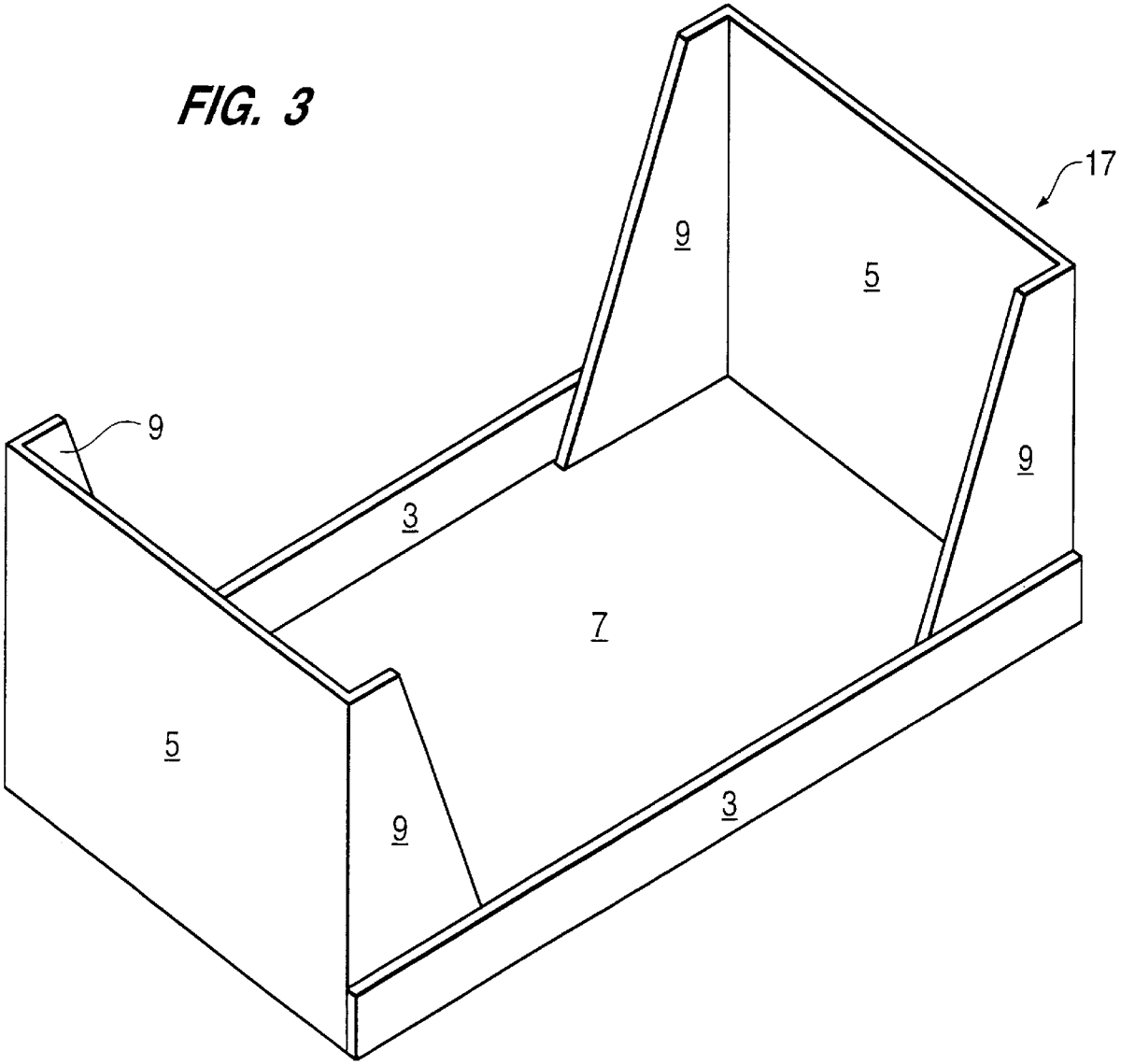
FIG. 3 is a perspective view of a wrap-type tray assembled from the blank of FIG. 1.

To construct a harness style tray 17 as shown in FIG. 3, end wall panels 5 (along with corner flaps 9) are folded upwards along their respective fold lines 13 to a position perpendicular to floor panel 7. The corner flaps 9 are folded inwardly along their respective fold lines 15 to an upstanding position perpendicular to end walls 5. Sidewalls 3 are then folded upwardly along their respective fold lines 11 into overlapping relation with a lower portion of each corner flap 9. Corner flaps 9 are then secured to short walls 3 by known means, e.g., adhesive, stapling, etc.

Numerous variations on the above-described tray construction are possible. For instance, corner flaps 9 may be folded inwardly before sidewalls 3 so that corner flaps 9 overlap sidewalls 3 on the outside. In lieu of flaps 9, a set of similar corner flaps could emanate from walls 3 for overlap and securement to end walls 5. Although construction of the tray from a foldable blank of disposable sheet material is preferred, it will be understood that the tray could be formed to be reused on a longer-term basis. To this end, various known structural materials, e.g., metals and plastics, and construction techniques, could be used. If a high rigid material is used, it may be possible to dispense with corner flaps 9 which add structural rigidity and strength to the container. Instead of forming uninterrupted surfaces, end walls 5 could have an additional opening or window for enhanced display of the contents.

Figure 2:
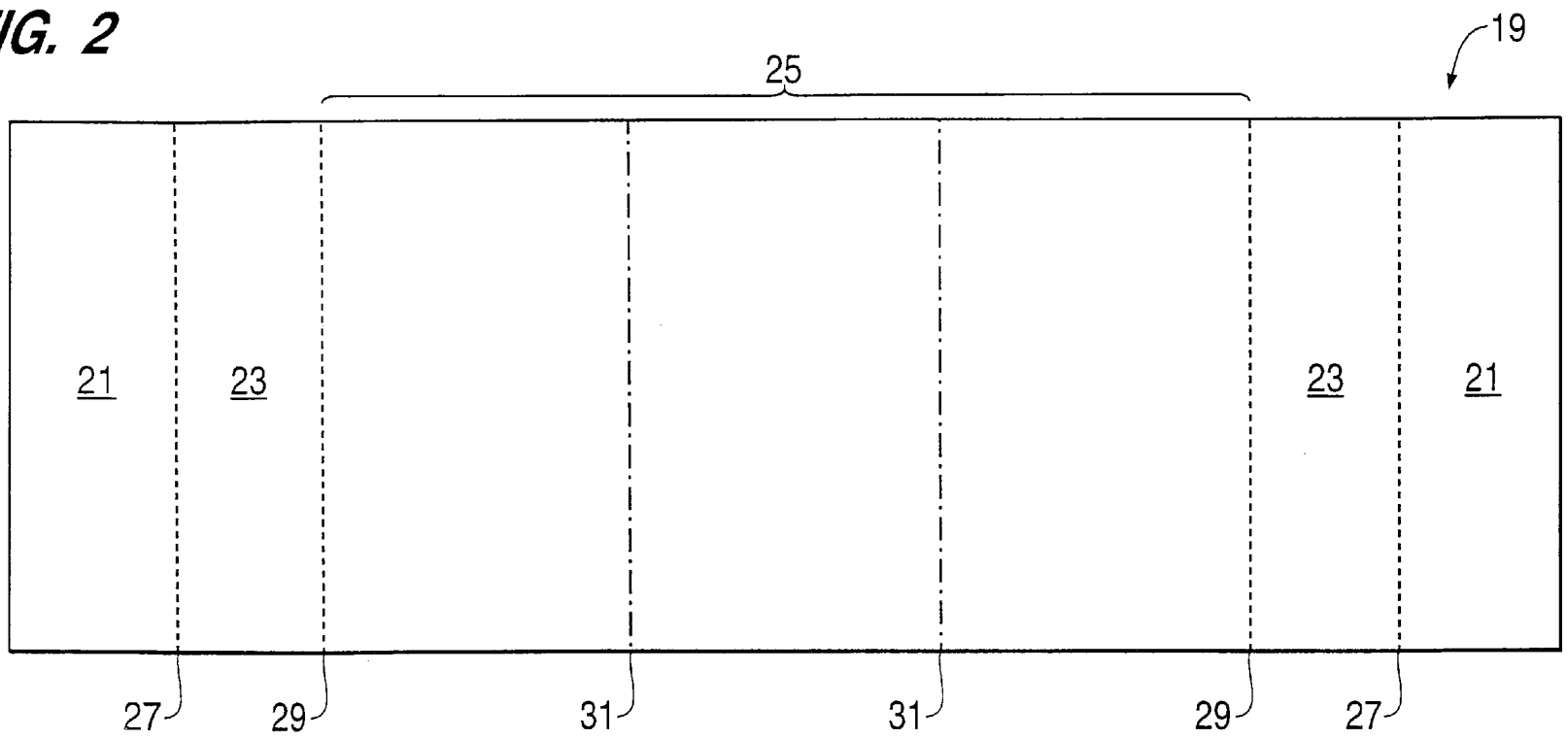
FIG. 2 is a plan view of a scored and cut blank foldable into a convertible sidewall/divider component to be incorporated into the tray of FIG. 1.

Referring now to FIG. 2, it is seen that a rectangular blank 19 of scored sheet material (e.g. corrugated fiberboard) used to form a convertible divider/sidewall component 20 (FIGS. 4–6) of the inventive container has regular score lines (shown in full-dotted line) defining five panels. Two relatively narrow end panels 21 are connecting panels serving to secure convertible component 20 in tray 17 (see FIG. 3). A pair of pivot panels 23 are provided adjacent connecting panels 21. As will be described, these panels pivot through 180° during a conversion of the container from a full-wall shipping mode to a partial-wall shipping/display mode. A relatively large main panel 25 is bracketed by pivot panels 23 and has two spaced parallel perforated score lines 31 denoted by partial break lines. Score lines 31 sub-divide main panel 25 into equal thirds.

Figure 4:
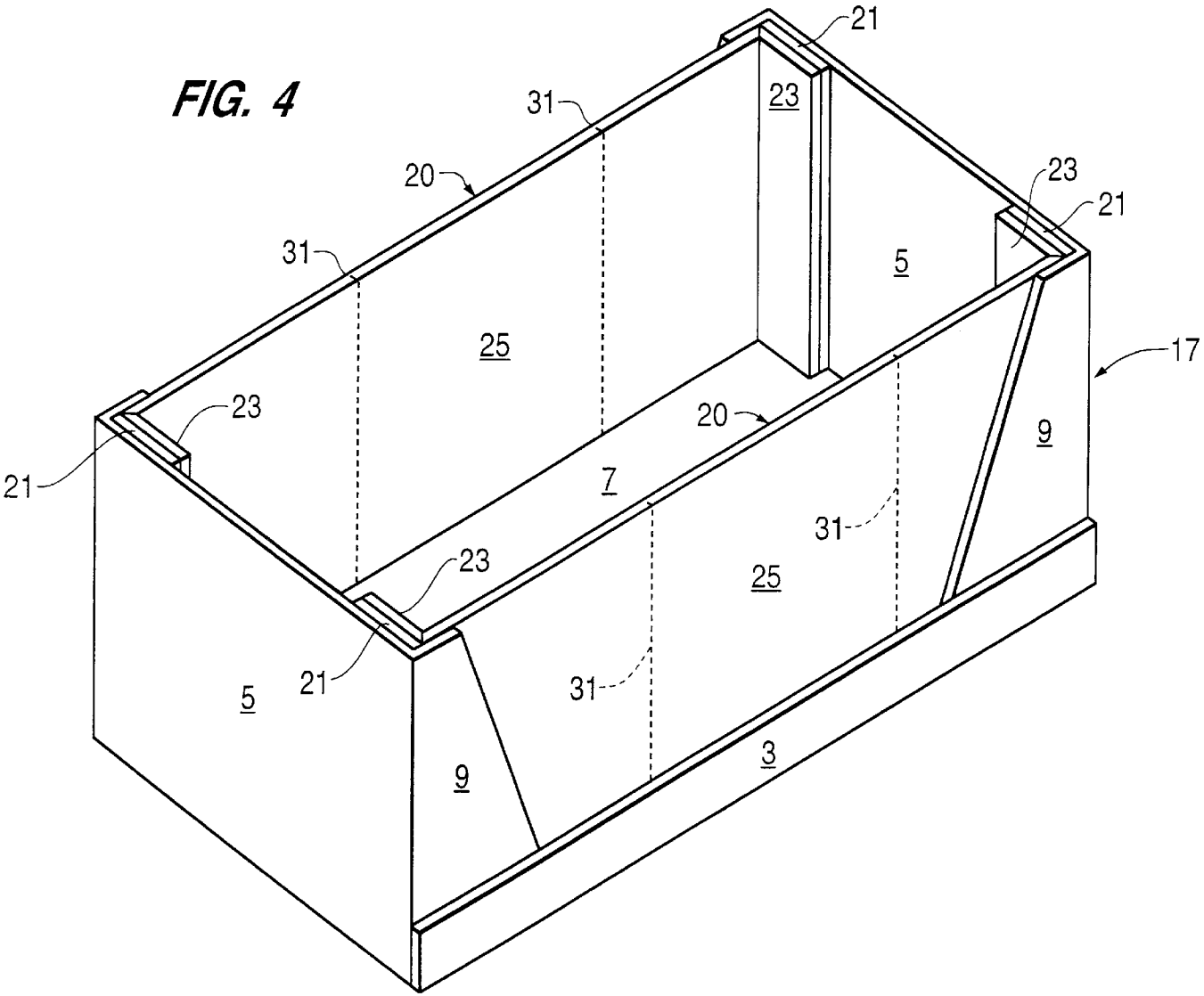
FIG. 4 is a perspective view of a convertible container in accordance with the invention, assembled from the wrap-type tray shown in FIG. 1, and two identical convertible sidewall/divider components constructed from blanks of the type shown in FIG. 2; the container is positioned in a full-wall shipping mode wherein respective main panels of the convertible sidewall/divider components serve to create a container with full sidewalls.

Convertible sidewall/divider component 20 is formed by folding pivot panels 23 at their respective fold lines 29 to respective positions perpendicular to main panel 25. Connecting panels 21 are doubled-back to overlap pivot panels 23 in an accordion-like manner. The convertible component is then secured inside tray 17 (as seen in FIG. 4) such that main panel 25 lies flush against an inside face of a corresponding sidewall 3, thereby forming a pair of complete or full sidewalls. The outward lateral faces of connecting panels 21 are set flush against the inside fits of end walls 5 and are secured thereto by known means (e.g., by adhesive, stapling, etc.). The bottom edge of the convertible sidewall/divider component sits upon floor 7. This forms a complete container, as shown in FIG. 4, in a full-wall shipping mode with convertible sidewall components 20 forming a pair of complete opposing sidewalls. While not shown, the container can optionally be provided with a conventional top closure.

In an exemplary application of the inventive container, empty plastic bottles are sent by a bottle manufacturer to a customer (e.g., product manufacturer) in a convertible container configured in the full-wall shipping mode shown in FIG. 4. The plastic bottles are empty and no divider is needed because the loads are relatively small. The bottles are typically supplied uncapped. Therefore, complete sidewalls are desirable to minimize contamination of the bottle interiors. The empty uncapped bottles are preferably shipped upside down as a further way to avoid contamination. As such, complete sidewalls are also desirable because the bottles would be prone to falling out if shipped in a display mode providing open sidewalls.

Once the empty bottles arrive at the manufacturer, they are unloaded, filled with flowable product (e.g., liquid) and capped. At this stage, prior to replacing the bottles in the container, the container is converted from the full-wall shipping mode to a partial-wall shipping/display mode (in a manner to be described). Finally, the filled bottles are reloaded into the container and the resultant packages are shipped to a retail establishment in a stackable display-ready form.

Figure 5:
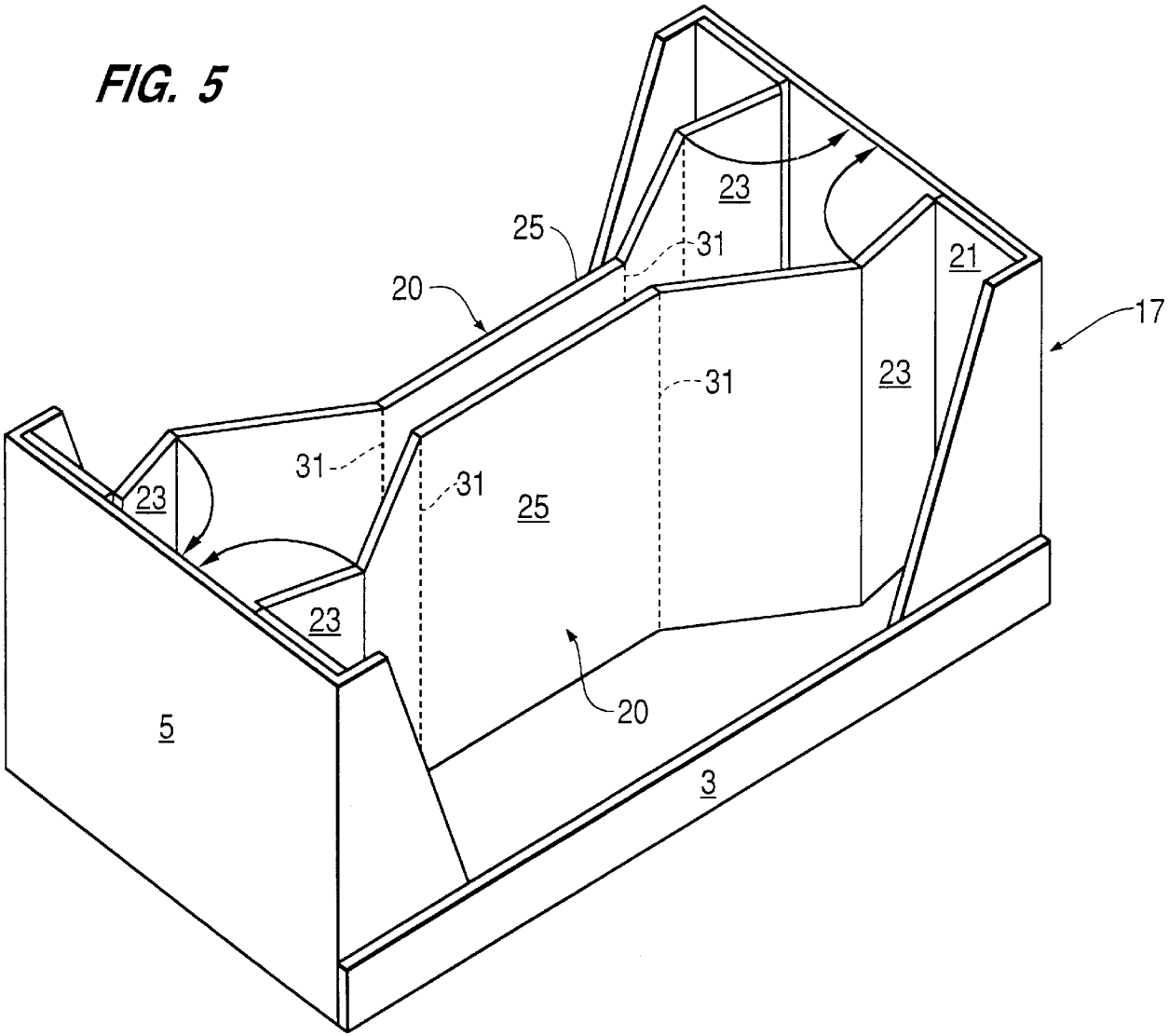
FIG. 5 is a perspective view of the container of FIG. 4, shown mid-way through a conversion from a full-wall shipping mode to a partial-wall shipping/display mode.
Figure 6:
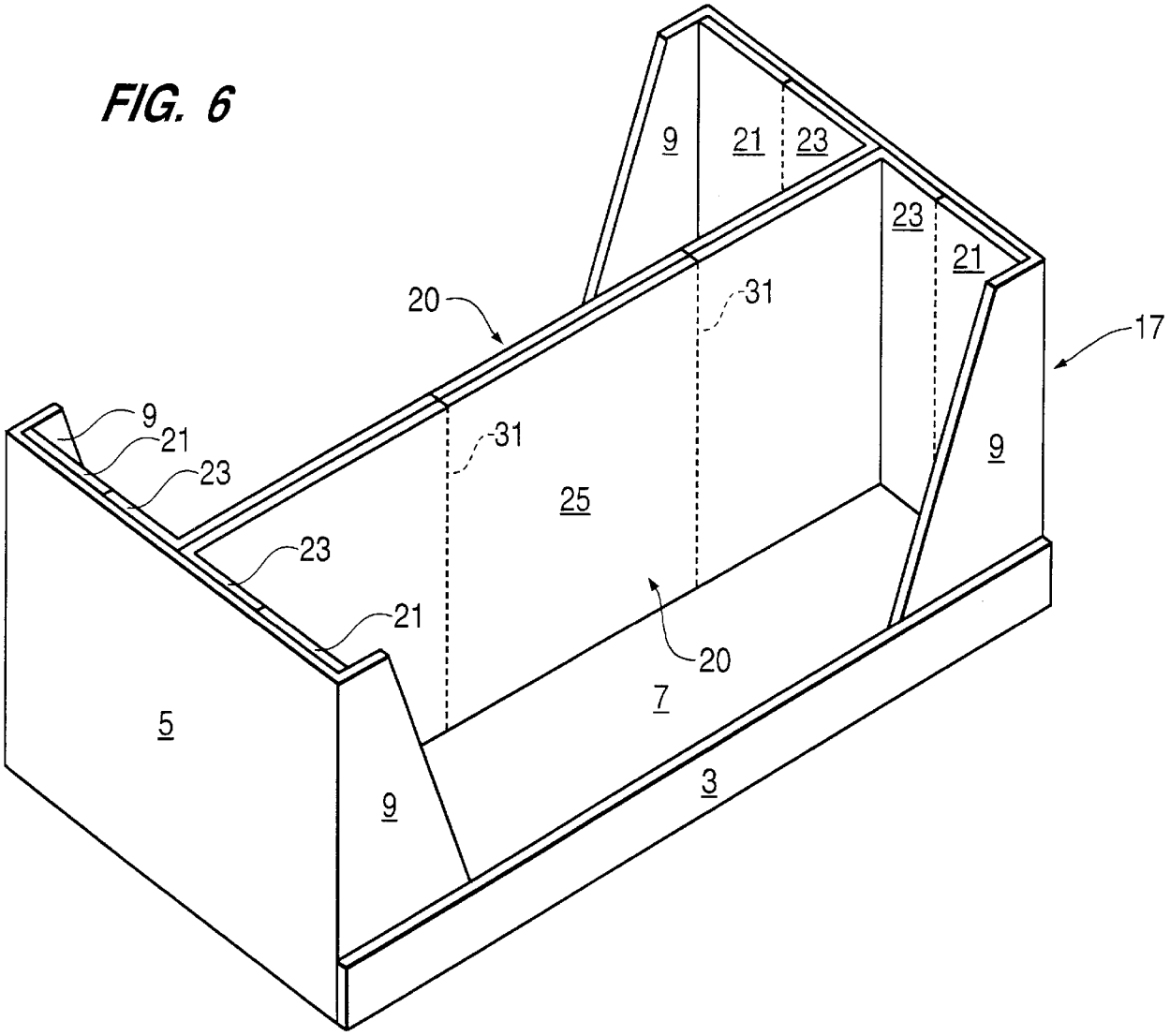
FIG. 6 is a perspective view of the container of FIG. 4, shown fully converted to the partial-wall shipping/display mode, wherein main panels of the convertible sidewall/divider components are positioned back-to-back to form an H-type divider.

Conversion from the full-wall shipping mode (FIG. 4) to the partial-wall shipping/display mode (FIG. 6) is accomplished by pressing inwardly on the center of main panel 25 of the two convertible sidewall/divider components 20, manually or by automated means. The use of automation allows the conversion to be performed quickly and easily in comparison to other known container conversion techniques, such as RSC's with tear-out panels that must be removed manually. As main panel 25 bows inwardly toward the middle of tray 17 under the lateral pressing force, it starts to fold or collapse at perforated score lines 31, and pivot panels 23 begin to pivot about their fold lines 27 with respect to connecting panels 21, as shown in FIG. 5. The movement continues until pivot panels 23 pivot through 180° to a position flush against the insides of end walls 5, adjacent to and co-planar with connecting panels 21. Main panels 25 are positioned flush against each other (back-to-back) along a longitudinal center line of tray 17, as shown in FIG. 6. The sidewall-divider components are held in this divider-forming position by a friction lock obtained by appropriate sizing of the component panels relative to tray 17.

It will be appreciated that a reverse arrangement of the connecting panels 21 and pivot panels 23 could be utilized, whereby pivot panel 23 is adjacent to and co-planar with connecting panel 21 in the full-wall shipping mode. In such an arrangement, pivot panel 23 would be pivotable 180° into overlapping relation with connecting panel 21 to effect a conversion of the container to the partial-wall shipping/display mode.

Perforated score lines 31 allow main panel 25 to collapse under the inward lateral pressing force applied during the conversion. At the same time, sufficient strength and rigidity in the full-wall shipping mode is maintained. While non-perforated score lines could be used, perforated score lines are preferred from a manufacturing perspective, since they can be formed from the same side of the blank as the other scores, and exhibit bi-directional foldability. It is possible to omit score lines 31 if main panel 25 can inherently bend sufficiently to allow pivoting of pivot panels 23 during the conversion. Preferably, connecting panels 21 remain securely attached to the inside faces of end walls 5 during the conversion, thereby lending greater rigidity and strength to the convertible container.

The back-to-back configuration of main panels 25 shown in FIG. 6 forms an H-type divider support. This type of divider adds greatly to the strength and rigidity of the convertible container in the shipping/display mode and, by dividing the container into cells, reduces damage due to shifting of the contents. Filled bottles (or other contents) loaded into the convertible container in this mode will be kept relatively free of stacking loads when the H-type support is configured to be taller than the bottles. When the bottles are of substantially the same height as the H-type support, stacking loads will be shared between the container and the contents. Thus, in the partial-wall shipping/display mode, the convertible container may be stacked for both shipment to the retailer and display at the retail establishment. It is also possible for the goods (e.g., bottles) in the convertible container to be taller than the H-type divider and end walls 5, in which case stacking will require the goods to have sufficient strength to bear the stacking loads. In this instance, convertible sidewall/divider component 20 would not perform a load bearing function, but would still advantageously serve to prevent shifting and abrasion of the goods.

Figure 7:
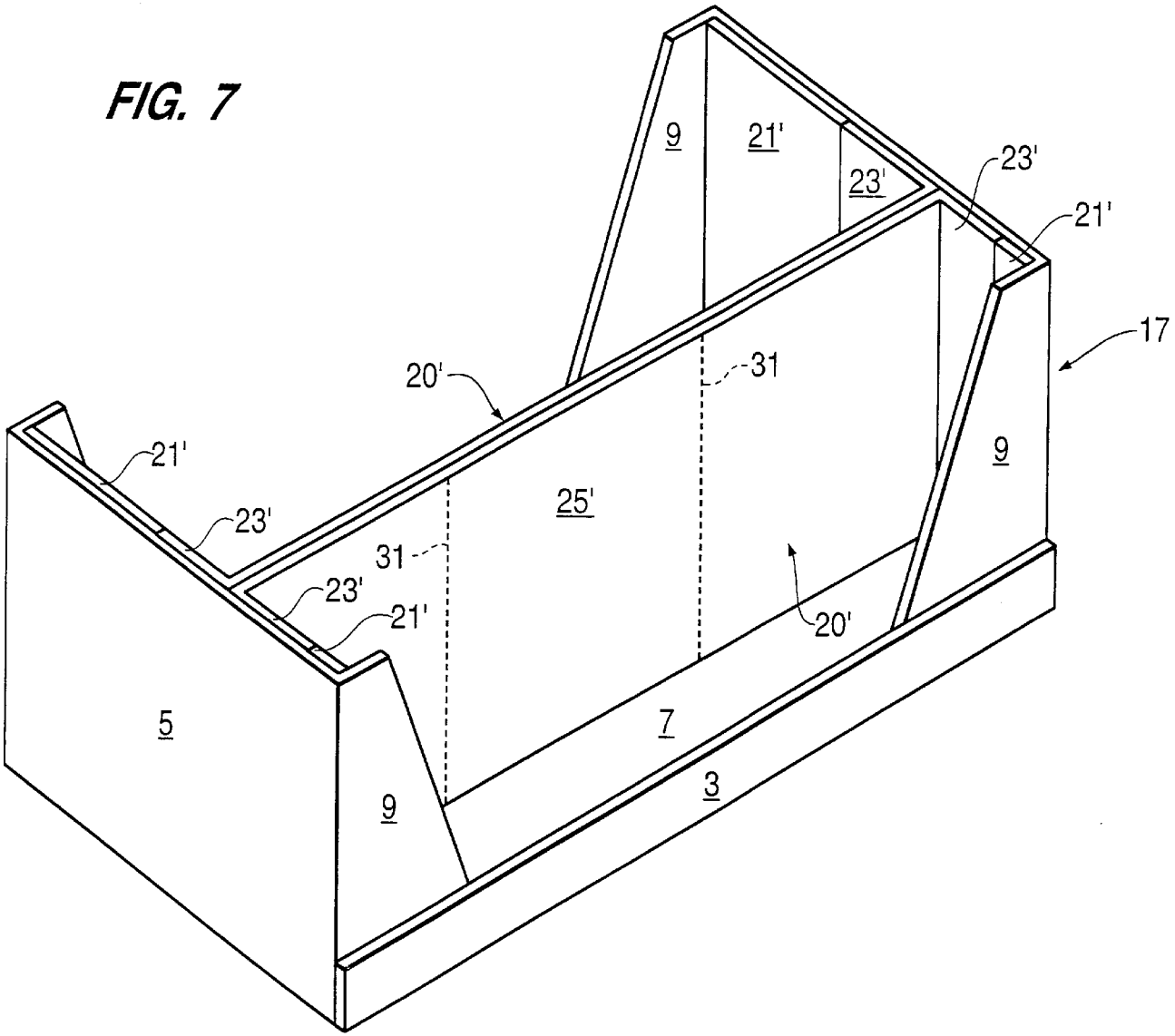
FIG. 7 is a perspective view of a container representing a second embodiment of the invention, wherein the two convertible sidewall/divider components come together at a position off-set with respect to a longitudinal container centerline, to form a pair of container cells of differing size.

The configuration of convertible sidewall/divider component 20 may be varied. Examples include an asymmetrical component 20' that forms, as shown in FIG. 7, an H-type divider where main panels 25' of the two convertible sidewall/divide components are flush, but meet along a line off-set from a centerline of tray 17. Such a configuration forms two container cells of different width. The asymmetry arises from the combined length of modified connecting panels 21' and modified pivot panels 23' being greater for one of the two convertible sidewall/divider components (backside component 20' as shown in FIG. 7) than for the other. In this embodiment, the composite width of the pair of components 20', provided by connecting panels 21' and pivot panels 23', remains substantially equal to the container width (length of end walls 5).

Figure 8:
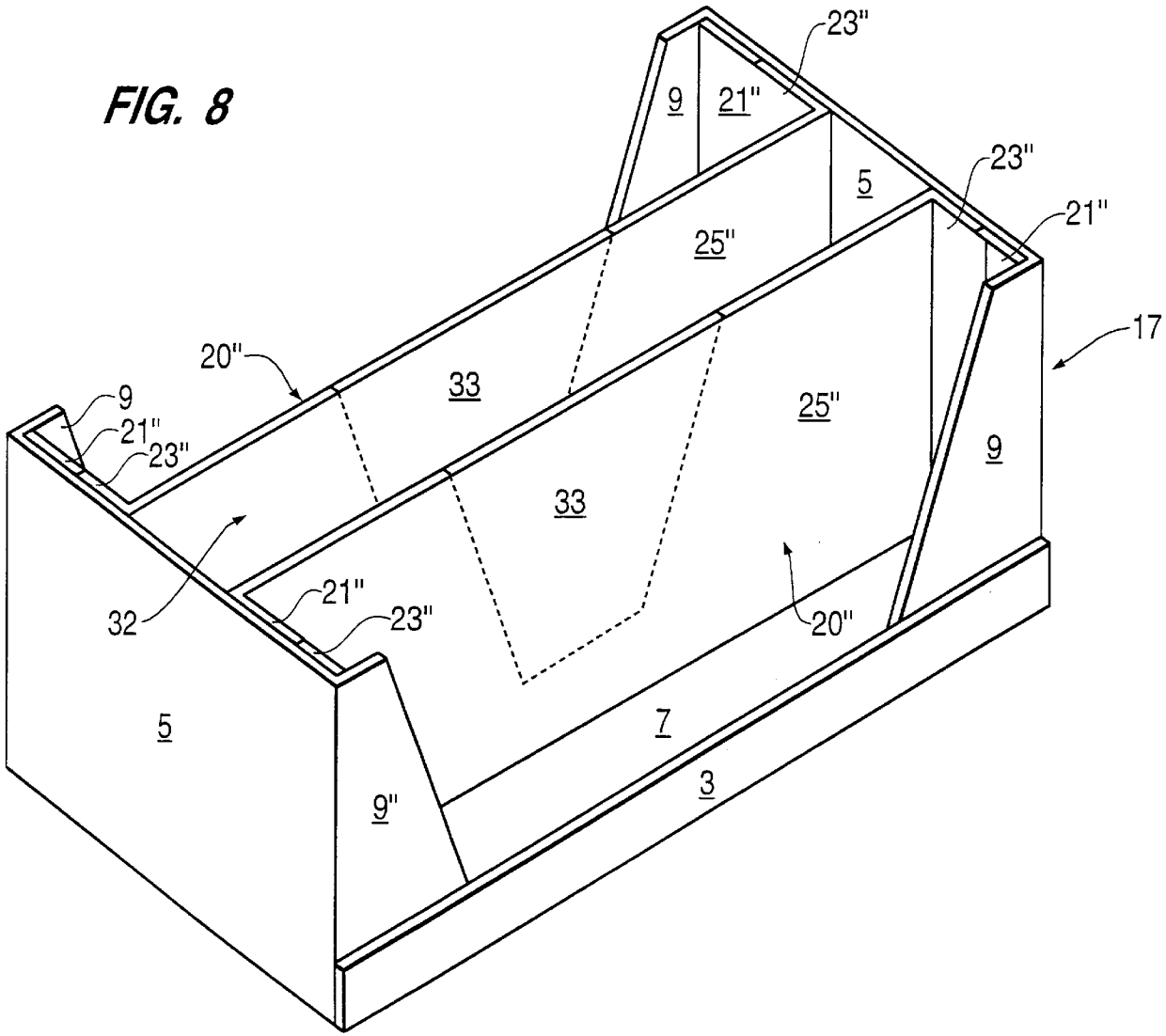
FIG. 8 is a perspective view of a container representing a third embodiment of the invention, wherein the two convertible sidewall/divider components remain spaced from each other to form, in the partial-wall shipping/display mode, a third cell therebetween.

In another variation shown in FIG. 8, the combined length of connecting panels 21" and pivot panels 23" of modified convertible components 20" is less than the container width. As a result, main panels 25" remain spaced from each other in the shipping/display mode, and a third container cell 32 is formed therebetween. Viewing of goods in third cell 32 may be aided by the provision of tear-out panels 33 in main wall panels 25".

The present invention has been described in terms of preferred and exemplary embodiments thereof. Numerous other embodiments, modifications and variations within the scope and spirit of the appended claims will occur to persons of ordinary skill in the art from a review of this disclosure. In particular, while the illustrated preferred embodiments provide gap-free full sidewalls (lengths equal to the length of tray 17, and height equal to the height of end walls 5), it will be understood that the invention is not so limited. Rather, the invention encompasses generally conversions between a shipping mode and shipping/display mode, wherein an increased sidewall surface area is provided in the shipping mode. This includes embodiments which provide less than full sidewalls in the shipping mode, such as where main panels 25 have less height than end walls 5, or where one or more openings are provided in main panels 25.

I claim:

1. A container convertible between a shipping mode and a shipping/display mode, comprising:

a tray including a floor and a pair of sidewalls and end walls connected to said floor, said sidewalls having an abbreviated height relative to said end walls; and a convertible sidewall/divider component secured within said tray, said component comprising a main panel extending above said sidewalls of the tray, said main panel being positioned along a respective one of said sidewalls to form a sidewall extension above said sidewall in the shipping mode, said main panel being movable within said tray, without removal therefrom, to a position spaced inwardly from said respective sidewall to form a divider defining separate compartments of said container visible above said respective sidewall in the shipping/display mode.

2. A convertible container according to claim 1, wherein a pair of said convertible sidewall/divider components are secured within said tray, and the main panels of each said component are, in said shipping/display mode, in back-to-back contact with each other forming an H-type divider.

3. A convertible container according to claim 2, wherein said pair of convertible sidewall/divider components have substantially equal dimensions forming a symmetrical H-type divider and equal size container cells.

4. A convertible container according to claim 2, wherein said pair of convertible sidewall/divider components are of differing dimensions forming an asymmetrical H-type divider and container cells of differing size.

5. A convertible container according to claim 2, wherein the main panels of the pair of convertible sidewall/divider components remain spaced apart from each other in the shipping/display mode, whereby a third container cell is formed between the spaced main panels.

6. A container convertible between a shipping mode and a shipping/display mode, comprising:

a tray including a floor and a pair of sidewalls and end walls connected to said floor, said sidewalls having an abbreviated height relative to said end walls; and a convertible sidewall/divider component secured within said tray, said component comprising:

a pair of connecting panels connected to interior sides of said end walls;

a pair of pivot panels attached to respective ones of said connecting panels, said pivot panels overlapping said respective connecting panels in one of said shipping mode and said shipping/display mode, and being pivotable with respect to said respective connecting panels to respective positions adjacent and generally co-planar with said connecting panels, to effect a conversion of the container to the other one of said modes; and a main panel attached to and extending between said pivot panels, and extending above said sidewalls of the tray, said main panel being positioned flush against a respective one of said sidewalls to form a sidewall extension above said sidewall in the shipping mode, said main panel being spaced inwardly from said respective sidewall in the shipping/display mode to form a divider defining separate compartments of said container visible above said respective sidewall.

7. A convertible container according to claim 6, wherein a pair of said convertible sidewall/divider components are secured within said tray, and main panels of each said component are, in said shipping/display mode, in back-to-back contact with each other forming an H-type divider.

8. A convertible container according to claim 7, wherein said pair of convertible sidewall/divider components have substantially equal dimensions forming a symmetrical H-type divider and equal size container cells.

9. A convertible container according to claim 7, wherein said pair of convertible sidewall/divider components are of differing dimensions forming an asymmetrical H-type divider and container cells of differing size.

10. A convertible container according to claim 7, wherein the main panels of the pair of convertible sidewall/divider components remain spaced apart from each other in the shipping/display mode, whereby a third container cell is formed between the spaced main panels.

11. A convertible container according to claim 10, wherein at least one of said main panels has a tear-out panel formed by lines of weakness therein, said tear-out panel being removable for increasing a visibility of goods within the third container cell.

12. A convertible container according to claim 6, wherein said main panel has at least one score line that allows said main panel to buckle during a conversion between said shipping mode and said shipping/display mode.

13. A convertible container according to claim 12, wherein said score line is a perforated score line.

14. A convertible container according to claim 12, wherein a pair of spaced buckle facilitating score lines are provided in said main panel.

15. A convertible container according to claim 6, wherein said tray further comprises corner flaps connecting said end walls and said sidewalls.

16. A convertible container according to claim 15, wherein said corner flaps emanate from opposite lateral sides of the end walls and are secured to respective inside faces of said sidewalls.

17. A convertible container according to claim 6, wherein said main wall panel provides, in said shipping mode, a full-wall panel with a height substantially equal to the height of the end walls, and no openings therein.

18. A convertible container according to claim 6, wherein said pivot panels are overlapped with said connect panels in said shipping mode, and adjacent and generally co-planar with the connecting panels in said shipping/display mode.

19. A convertible sidewall/divider component for use in a container convertible between a shipping mode and a shipping/display mode, comprising:

a pair of connecting panels;

a pair of pivot panels ached to respective ones of said connecting panels, said pivot panels being doubled back into overlapping relationship with said connecting panels to achieve one of said shipping mode and said shipping/display mode, and being pivotable with respect to said respective connecting panels to achieve the other of said modes; and a main panel attached to and extending between said pivot panels, said main panel comprising at least one line of weakness that allows said main panel to buckle during a conversion between said shipping mode and said shipping/display mode.

20. A convertible sidewall/divider component according to claim 19, wherein said line of weakness is a perforated score line.

21. A convertible container according to claim 19, wherein a pair of buckle facilitating lines of weakness are provided in said main panel.

* * * * *

UNITED STATES PATENT AND TRADEMARK OFFICE

CERTIFICATE OF CORRECTION

PATENT NO.: 5,967,406

DATED: October 19, 1999

INVENTOR(S): Stephen E. MOORMAN

It is certified that an error appears in the above-identified patent and that said Letters Patent is hereby corrected as shown below:

In Claim 19 (Column 8, Line 45), please replace "ached" with --attached--.

Signed and Sealed this

First Day of August, 2000

*Attest:*

Q. TODD DICKINSON

*Attesting Officer*

*Director of Patents and Trademarks*